US005110123A

United States Patent [19]

Larson

[11] Patent Number: 5,110,123

[45] Date of Patent: May 5, 1992

[54] COMBINED DIVOT REPAIRER AND BALL MARKER/SPOTTER

[76] Inventor: George G. Larson, 11916 W. Washington Blvd., Los Angeles, Calif. 90066

[21] Appl. No.: 720,013

[22] Filed: Jun. 24, 1991

[51] Int. Cl.[5] ..... A63B 57/00

[52] U.S. Cl. ..... 273/32 A; 273/32 B; 224/918; 172/378; 172/713

[58] Field of Search ..... 273/32 A, 32 B, 162 A, 273/162 D, 162 F; 224/918; 172/378, 713; 116/222

[56] References Cited

U.S. PATENT DOCUMENTS

| | | | |
|---|---|---|---|
| 4,475,676 | 10/1984 | Smith | 273/32 B X |
| 4,998,726 | 3/1991 | Budnick | 273/32 B X |
| 3,309,089 | 3/1967 | Doyle | 273-32 |
| 3,622,157 | 11/1971 | Hatch | 273-32A |
| 3,744,542 | 7/1973 | Stephens et al. | 273-32A |
| 4,151,937 | 5/1979 | Jarosh et al. | 273-32A |
| 4,475,676 | 10/1984 | Smith | 224-247 |
| 4,736,877 | 3/1988 | Clark | 273-32AX |
| 4,960,239 | 10/1990 | Wait | 273-32B |
| Des. 216,816 | 3/1970 | Bennett | D21-234 |
| Des. 247,790 | 4/1978 | Jackson | D21-234 |
| Des. 290,985 | 7/1987 | Dikoff | D21-234 |
| Des. 315,009 | 2/1991 | Ingalls | D21-234 |

FOREIGN PATENT DOCUMENTS

| | | | |
|---|---|---|---|
| 2219513 | 12/1989 | United Kingdom | 273/32 B |

*Primary Examiner*—George J. Marlo
*Attorney, Agent, or Firm*—Lewis B. Sternfels

[57] ABSTRACT

A golf tool combination (20) of a divot repairer (22) and a ball marker or spotter (26) comprises a pair of markers joined together as a unit (24) by legs (42) with a lip (48) of one marker engaging indentations (38) in the other marker. A space (28) provided between the markers receives and holds divot repairer (22) between the markers in the space. Prongs (62) in repairer (22) resiliently engage curved surfaces (52) on legs (42) to ensure that the divot repairer is held with the assembled together markers. A V-shaped portion (64) joins the prongs and enables a user to grip, position and manipulate the repairer in a relatively pressure-free manner when used to repair and replace divots.

10 Claims, 3 Drawing Sheets

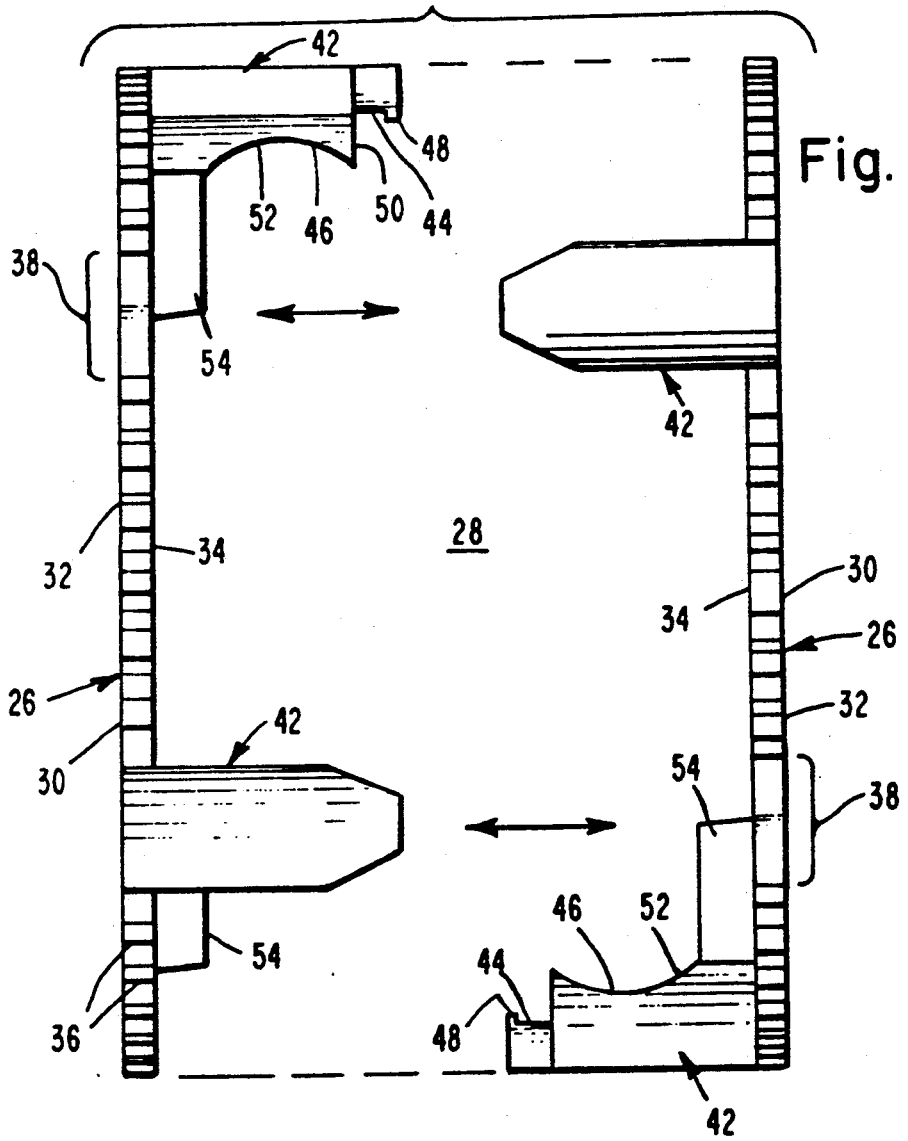
Fig. 7.
Fig. 8.
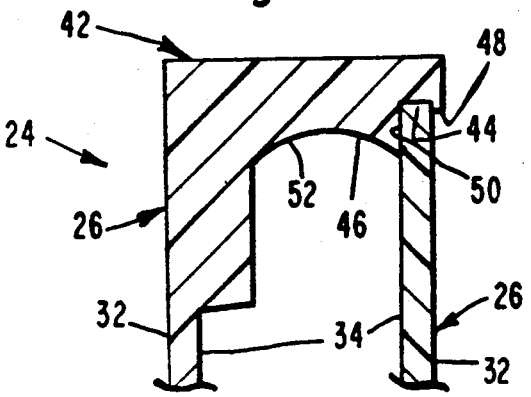

COMBINED DIVOT REPAIRER AND BALL MARKER/SPOTTER

BACKGROUND OF THE INVENTION

1. Field of the Invention

The present invention relates to divot repair tool devices and ball marker/spotter devices and, in particular, to improvements in each device and a novel combination of the two devices.

2. Description of Related Art and Other Considerations

The game of golf has been a great impetus for its players to devise accessories and implements, such as holders for tees and for tools useful in the repair or replacement of divots and in the marking or spotting of balls.

The present invention is particularly concerned-with holders for divot repair and marker/spotter tools. It is desirable that the holder be simple and inexpensive, yet functionally effective as well as useful additionally as a tool or a support therefor.

For the tool function of repair or replacement of divots, the tool should be capable of being easily gripped and manipulated. The user should not be required to unduly squeeze the tool in order to hold it both stable and in proper position with respect to the divot.

The ball marking or spotting tool should be capable of being placed and retained in the soil against, for example, any tendency of grass or other matter to push it from its engagement with the soil. When not so used, it should be securely retained as a unit with the divot repair tool.

The patent literature is replete-with many holders which aim to meet these goals, but not necessarily with great success.

Illustrative of U.S. utility patents includes U.S. Pat. No. 3,309,089 for a golfer's aid including a ball marker, plumb and turf repair tool, U.S. Pat. No. 3,622,156 for a golf green repair tool and golf ball marker assembly, U.S. Pat. No. 3,744,542 for a golf tool and marker case, U.S. Pat. No. 4,151,937 for a device holding such golf items as tees, markers and a divot repairer, U.S. Pat. No. 4,475,676 for an easy carry-easy access golf marker and tee caddie, U.S. Pat. No. No. 4,736,877 for a golf accessory holder of a divot repairer, markers and tees, U.S. Pat. No. 4,960,239 for a golf tool and carrier for such golf items as tees and markers.

Examples of U.S. design patents include U.S. Pat. No. 216,816 for a golfer's accessory kit incorporating tees, markers and a divot repairer, U.S. Pat. No. 247,790 for a combined golf ball marker and divot replacement tool, U.S. Pat. No. 290,985 for a marker, divot repairer and knife tool, and U.S. Pat. No. 315,009 for a combined golf tool and coin holder.

SUMMARY OF THE INVENTION

The present invention comprises a novel golf tool combination of a divot repairer and a ball marker and improvements in each device. A pair of markers are releasably joined together into a unit which can be disassembled. When assembled, the markers define a space for releasably holding a divot repairer. The repairer is configured not only to provide a space for the markers but also to define a gripping space for the user. The repairer may be removed for replacement of divots. The markers may be disassembled so that each may be used to spot a golf ball.

Several advantages are derived from this arrangement. The present invention simplifies and makes more convenient many of its predecessors. For example, the user can easily assemble and disassemble the unit; special holding mechanisms, which have no function other than to support tools or tees, are dispensed with. The divot repair tool can be easily gripped and manipulated by the user. The markers can be securely placed and retained in the soil the mark a ball's position. The assembly is compact, and can be carried in the user's pocket or golf bag. It can be easily and inexpensively manufactured, such as by metal stamping and by plastic molding.

Other aims and advantages, as well as a more complete understanding of the present invention, will appear from the following explanation of an exemplary embodiment and the accompanying drawings thereof.

BRIEF DESCRIPTION OF THE DRAWINGS

FIG. 7 is an illustration of a pair of markers or spotters aligned with each other in preparation to being latched together as a unit and as a holder for the divot repair tool;

FIG. 8 is a cross-sectional view of a leg portion of the latched together markers or spotters.

DETAILED DESCRIPTION OF THE PREFERRED EMBODIMENTS

Figure 1:
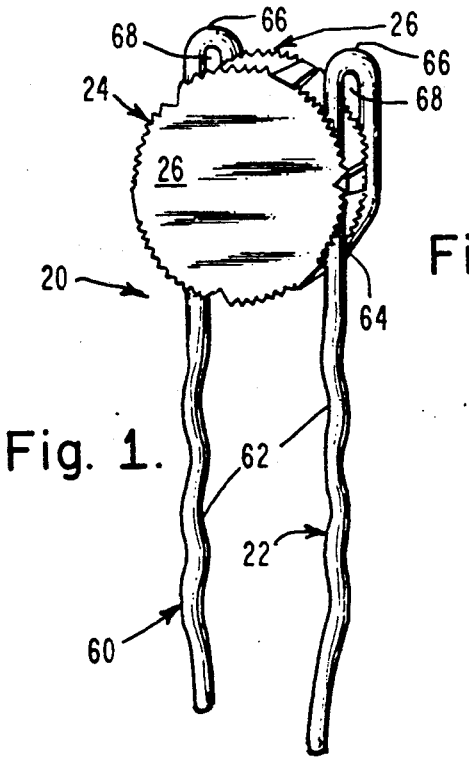
FIG. 1 is perspective view of the present invention in its assembled condition.
Figure 3:
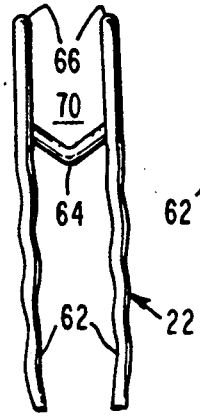
FIG. 3 is a front view of the divot repair tool.
Figure 4:
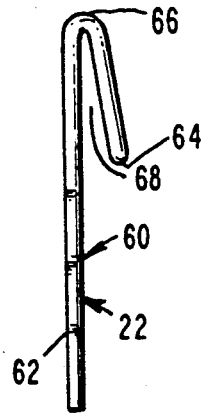
FIG. 4 depicts a side view of the divot repair tool.
Figure 2:
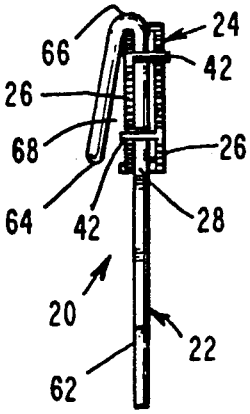
FIG. 2 is a side view of the assembly illustrated in FIG. 1.
Figure 5:
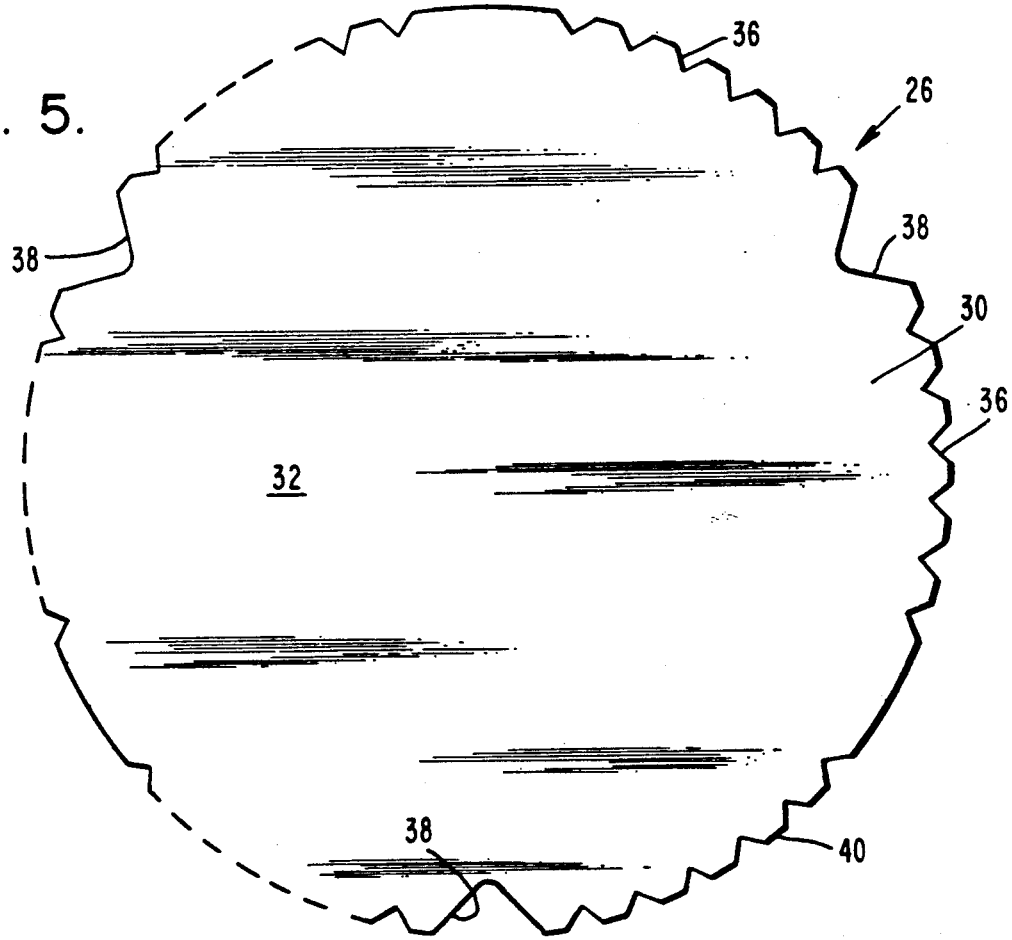
FIG. 5 shows a view of the upper side of one of the ball markers or spotters.
Figure 6:
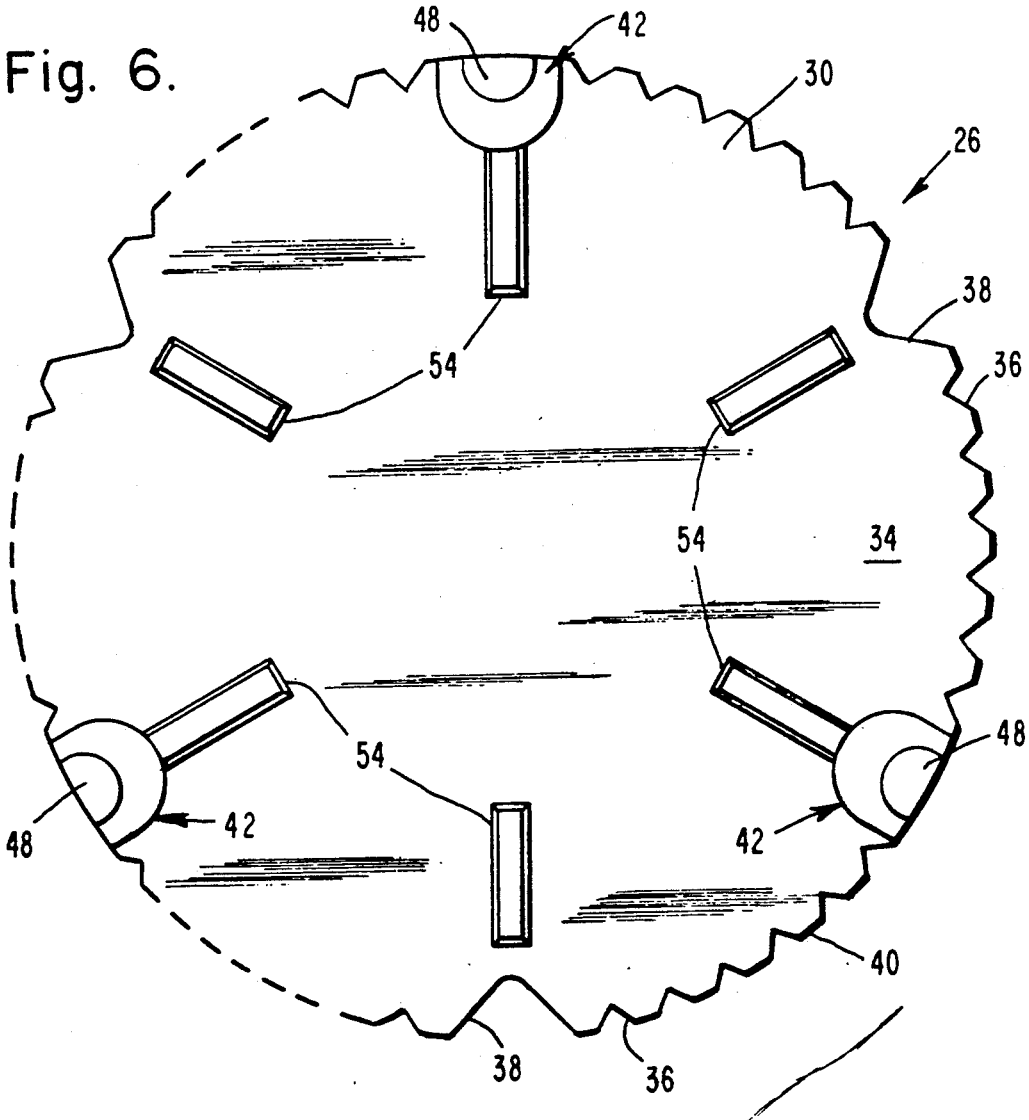
FIG. 6 is view of the lower side of one of the ball markers or spotters.
Figure 9:
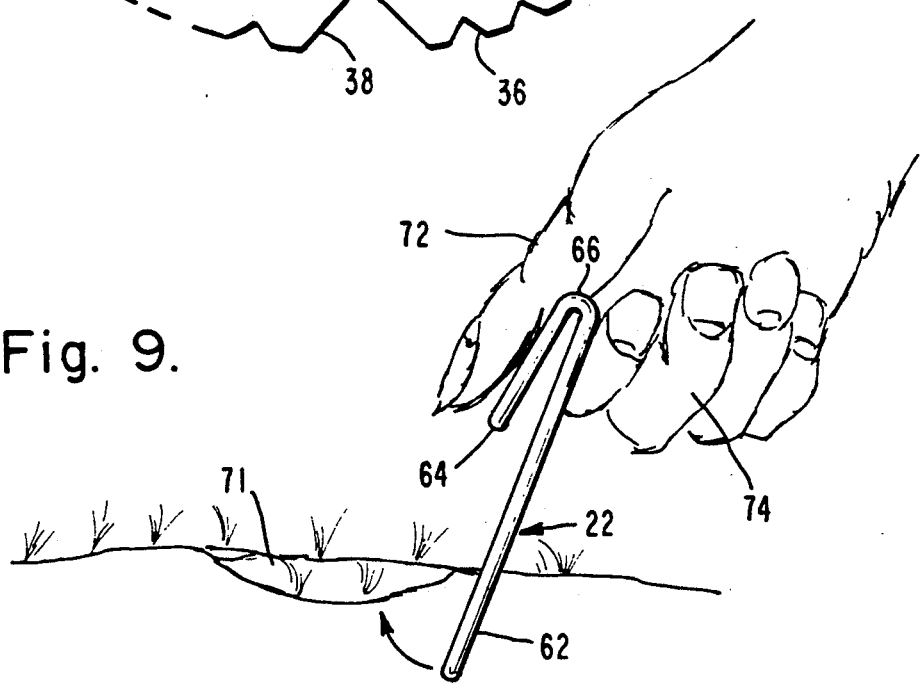
FIG. 9 is a view illustrating the use of the divot repair tool for repairing a divot.

As shown in FIGS. 1–4, a golf tool combination 20 includes a divot repairer 22 and a ball marker holder or unit 24. Holder 24 comprises a pair of markers or spotters 26, which are releasably joined together into a unit which can be easily assembled and disassembled, as illustrated in FIG. 7. When assembled, markers 26 define a space 28 (see FIG. 2) for holding divot repairer 22. The repairer can be removed for replacement of divots, as shown in FIG. 9. The markers may be disassembled so that each may be used to spot a golf ball.

Ball marker/spotter 26 is used by a first golfer to mark or spot the location of his ball,.which can then be removed temporarily, for example, to permit play by a second player. Thereafter, the first player then replaces the ball where marked by spotter 26 to resume his play.

Markers or spotters 26 preferably are configured identically and in a manner which permits them to be latched together and to provide space 28 for receipt of divot repairer 22. In the preferred configuration, as best depicted in FIGS. 5–8, each marker comprises a circular disc or base 30 having an upper side 32, a lower or under side 34, a plurality of serrations 36 and three indentations 38, both evenly distributed about periphery 40 of the marker. Indentations 38 differ from serrations 36 in degree of size, and are placed 120° about periphery 40.

Three legs 42 extend from underside 34 of disc 30, and are also spaced 120° apart from one another and 60° from serrations 36. Each leg 42 includes two undercuts 44 and 46, which are best seen in FIGS. 7 and 8. Undercut 44 is bounded by a lip 48 and a transition 50. Lip 48 terminates leg 42 and transition 50 joins undercuts 44 and 46. Undercut 46 is further provided with a curved surface 52. Marker or spotter 26 is completed with a plurality of six ledges 54, of which three extend from legs 42 towards the center of the disc.

To assemble the two discs into a unit, legs 42 of one disc are aligned with indentations 38 of its mating disc, and when fully inserted into indentations 38, lips 48 of legs 42 snap over upper side 34 of disc 30 and transition 50 contacts underside 34 to lock the two discs together. When the discs are so assembled into a unit, curved surfaces 52 of both discs form a circular, three-dimensional surface, bounded also by ledges 54 on under sides 34 of the discs, for reception of divot repairer 22.

When used as a marker or spotter, lips 48 also act as anchors in the soil for resisting movement of marker 26 out of the soil, especially against the spring-like force of any grass acting against underside 34 of the marker.

Referring again to FIGS. 1–4, divot repairer 22 is formed from a bent stiff wire 60 which is configured into a pair of undulated prongs 62 joined together at a V-shaped portion 64. The prongs are cold worked from a straight-wire form into their undulated configuration to stiffen them, and may be simply cut or rounded to provide jagged or smooth termini, as desired.

V-shaped portion 64 is bent back over prongs 62 at bends 66 and defines a space 68 for receipt of one of a pair of latched together markers 24. This bending back of V-shaped portion 64 also forms a thumb receiving slot 70. The closed end of slot 70 also provides the important function of acting as a stop to the user's thumb, thereby permitting the user to easily grip divot repairer tool 22 with the exertion of a minimum of pressure and to prevent strain on the user. In addition, the configuration of tool 22 enables the user to facilely position the prongs in readiness for repair and replacement of the divot.

As shown in FIG. 9, bent stiff wire device or divot repairer 22 is used to replace a divot 71 by gripping the divot repairer between one's thumb 72 in slot 70 and finger 74 against prongs 62 to hold repairer 22 securely. The ends of prongs 62 are then manipulated in a conventional manner to replace divot 71, that is, the ends are used to poke into and soften up the soil, which is then tamped smooth.

When not in use, repairer 22 is adapted to be inserted into space 28 between unit 24 of assembled markers 26, with its prongs 62 pressing resiliently into contact with four of curved surfaces 52 on legs 42. The undulations in prongs 62 press and retain the prongs of divot repairer 22 against curved surfaces 52 and, therefore, enable repairer 22 to be retained-within unit 24 of the two locked-together markers.

Although the invention has been described-with respect to a particular embodiment thereof, it should be realized that various changes and modifications may be made therein without departing from the spirit and scope of the invention.

I claim:

1. A combined divot repair and ball marker golf tool comprising:

a divot repairer;

a pair of identically configured markers which are latchable together as a unit for providing a space for holding said divot repairer, each said marker being configured as a disc with a circular periphery and bounded by upper and lower sides, each said marker being provided with a plurality of serrations and three indentations evenly distributed about the periphery, said indentations differing from said serrations in degree of size, and placed 120° from one another about the periphery, three legs extending from said lower side and being spaced 120° apart from one another and 60° from said indentations, each said leg including two undercuts, a first of said undercuts being bounded in a lip at the leg's distal end facing inwardly of its disc and by a transition which joins said undercuts, and a second of said undercuts being provided with a curved surface, and six ledges evenly distributed about and extending from said lower side, of which three of said ledges extend inwardly of the periphery from said legs, said legs of a first of said discs being alignable respectively with said indentations of a second of said discs and said lips of said first disc capable of being snapped respectively over said upper side of said second disc, for contacting said transition with said lower side, for locking said discs together, and for assembling said discs into a unit, said thus assembled discs configuring said curved surfaces of both said discs into an annularly shaped surface, bounded by said ledges on said lower sides of said discs, for reception of said divot repairer, said lips, when said markers are not assembled together as a unit, being capable of acting as means for anchoring each of said markers in the soil for resisting movement of the marker out of the soil, and against the spring-like force of any grass acting against said lower side; and said divot repairer being formed from a bent stiff wire having a pair of undulated prongs joined together at a V-shaped portion, said prongs being cold worked from a straight wire for forming them into their undulated configuration for stiffening purposes, said V-shaped portion being bent back over said prongs at bends for defining a space for receipt of one of said markers when assembled together as a unit and said undulated configuration being adapted to resiliently engage said curved surfaces of said markers when assembled together for retention thereof and a marker-divot repairer combination, said bent back portion of said V-shaped portion also forming a thumb-receiving slot useful for enabling a user of said repairer to grip said divot repairer with a minimum of pressure, to properly position and manipulate said divot repairer and thereby to replace divots.

2. A golf tool combination comprising a divot repairer and a pair of ball markers, each of which includes integral means for enabling said markers to be joined together as an independent unit, to be separated from one another and to be rejoined as an independent unit, and for defining a space therebetween, and said divot repairer being releasably held by said markers in the space therebetween, thereby enabling said divot repairer to be alternately separated from and held by said markers.

3. A golf tool combination of a divot repairer and a ball marker comprising:

a pair of markers, each of said markers including leg engageable means and generally normally extending legs, said legs of a first of said markers being alignable and engageable respectively with said leg engageable means of a second of said markers for releasably securing and assembling said markers together into the unit and for defining a space; and a divot repairer releasably held between said markers in the space.

4. The combination according to claim 3 in which said divot repairer includes a pair of prongs insertable into the space in holding a engagement with said legs.

5. The combination according to claim 4 in which said prongs have an undulated configuration and are biased into the holding engagement with said legs.

6. The combination according to claim 5 in which divot repairer further includes a V-shaped portion which joins said prongs and is bent back thereover to define a space for receipt of one of said markers, said bent-back V-shaped portion also forming a thumb-receiving slot for enabling facile and relatively pressure-free gripping, positioning and manipulation of said divot repairer for replacement of divots.

7. The combination according to claim 6 wherein said prongs are cold worked from a straight wire for being formed into the undulated configuration for purposes of stiffening the wire.

8. A golf tool combination of a divot repairer and a ball marker comprising:

a pair of markers, each of said markers including a base having indentations distributed about its periphery, legs extending from said base, being spaced apart from one another and from said indentations, and terminating in indentation engageable means, said legs of a first of said markers being alignable respectively with said indentations of a second of said markers and engageable therewith, for locking said markers together, and for assembling said markers into a unit, said indentation engageable means, when said markers are not assembled together as a unit, being capable of acting as means for anchoring each of said markers in soil for resisting movement of the marker out of the soil, and against any spring-like force of any grass acting against said marker; and a divot repairer releasably held by said legs between said markers.

9. The combination according to claim 8:

wherein each of said indentation engageable means comprises a lip, and each of said legs includes two undercuts, a first of which undercuts is bounded by said lips at the leg's distal end and by a transition joining said undercuts, and a second of which undercuts is provided with a curved surface; and further comprising ledges evenly distributed about and extending from one side of said marker, a number of said ledges extending inwardly of the periphery from said legs.

10. The combination according to claim 9 wherein said divot repairer includes a pair of undulated prongs joined together at a V-shaped portion which is bent back over said prongs at bends for defining a space for receipt of one of said markers when assembled together as the unit, said undulated configuration having an arrangement which is adapted for resilient engagement with said curved surfaces of said markers, when assembled together, for retention of said divot repairer in said markers, and said bent back portion of said V-shaped portion also forming a thumb-receiving slot useful for enabling a user of said repairer, when removed from said markers, for enabling manipulation of said divot repairer and thereby for replacement of divots.

* * * * *